US008800211B2

(12) United States Patent
Sharkey

(10) Patent No.: US 8,800,211 B2
(45) Date of Patent: Aug. 12, 2014

(54) RAINWATER GUTTER

(76) Inventor: Oliver Sharkey, Carrick on Shannon (IE)

( * ) Notice: Subject to any disclaimer, the term of this patent is extended or adjusted under 35 U.S.C. 154(b) by 0 days.

(21) Appl. No.: 13/699,249

(22) PCT Filed: Jul. 18, 2011

(86) PCT No.: PCT/IE2011/000036

§ 371 (c)(1),
(2), (4) Date: Nov. 20, 2012

(87) PCT Pub. No.: WO2011/148362

PCT Pub. Date: Dec. 1, 2011

(65) Prior Publication Data

US 2013/0067830 A1 Mar. 21, 2013

(30) Foreign Application Priority Data

May 26, 2010 (IE) ..... S2010/0342

(51) Int. Cl.
*E04D 13/00* (2006.01)

(52) U.S. Cl.
USPC ..... 52/11; 52/16

(58) Field of Classification Search
USPC ..... 52/11–16; 248/48.1, 48.2; 210/155
See application file for complete search history.

(56) References Cited

U.S. PATENT DOCUMENTS 603,611 A 5/1898 Nye
2,988,226 A 6/1961 Campbell
3,388,555 A * 6/1968 Foster ..... 405/119
4,757,649 A * 7/1988 Vahldieck ..... 52/12
4,858,396 A 8/1989 Rose
5,457,916 A * 10/1995 Tenute ..... 52/12
5,497,583 A * 3/1996 Rhoads ..... 52/12
5,791,091 A * 8/1998 Barbera ..... 52/12
5,799,445 A * 9/1998 Kock ..... 52/16
6,161,338 A * 12/2000 Kuhns ..... 52/12

(Continued)

FOREIGN PATENT DOCUMENTS

GB 2002046 2/1979
GB 2002046 A * 2/1979 ..... E04D 13/04

(Continued)

OTHER PUBLICATIONS

International Searching Authority, International Search Report and Written Opinion for PCT International Patent Application No. PCT/IE2011/000036, Sep. 6, 2011, 9 pages.

*Primary Examiner* — William Gilbert
*Assistant Examiner* — Beth Stephan
(74) *Attorney, Agent, or Firm* — Meyer IP Law Group

(57) ABSTRACT

The present invention relates to a rainwater gutter for mounting on a building to collect rainwater from the roof. It is shaped similar to a letter S. The rainwater flows from the roof covering onto the top section of the S shaped curved element, where, due to the contour of the gutter and surface tension will flow down from the upper curved section into the cylindrical section via the opening formed by the bottom section of the S returning to terminate as an open end close to the top section. The small opening also emits daylight thus reducing the possibility of vegetation growing in the gutter. This will reduce expensive and dangerous maintenance of eave gutters. Because the water gathered from the eave of the roof is cleaner it would reduce filtration costs for rainwater harvesting. The gutter can be formed in plastic, aluminum, copper or zinc.

19 Claims, 4 Drawing Sheets

(56) References Cited

U.S. PATENT DOCUMENTS

| | | | | |
|---|---|---|---|---|
| 6,182,399 | B1 * | 2/2001 | Pollera | 52/11 |
| 6,688,045 | B1 * | 2/2004 | Pilcher | 52/12 |
| 6,883,760 | B2 * | 4/2005 | Seise, Jr. | 248/48.1 |
| 6,988,335 | B2 * | 1/2006 | Eyers | 52/12 |
| 7,076,921 | B2 * | 7/2006 | Spradlin | 52/11 |
| 2001/0032418 | A1 * | 10/2001 | Richardson | 52/11 |

FOREIGN PATENT DOCUMENTS

| | | | | |
|---|---|---|---|---|
| JP | 9279781 | | 10/1997 | |
| NL | 9001479 | * | 1/1992 | E04D 13/06 |
| WO | 9953157 | | 10/1999 | |
| WO | WO 0012838 A1 | * | 2/2000 | E04D 13/064 |
| WO | 0012838 | | 3/2000 | |

* cited by examiner

RAINWATER GUTTER

CLAIM OF PRIORITY

This application is a 371 application of International Patent Application No. PCT/IE2011/000036; inventor Oliver Sharkey, filed Jul. 18, 2011; which claims priority to Ireland Patent Application No.: IE S2010/0342, filed May 26, 2010.

FIELD OF INVENTION

The present invention relates to a gutter for mounting on the fascia of a building, such gutters are widely used to collect rainwater from the roof of the building and direct it conveniently to the drain.

BACKGROUND

The majority of gutters comprise of open semi-circular channels or similar located on the fascia of the building such that rainwater flows from the roof into the open channel and is then directed into the drain via a downpipe. This type of gutter is manufactured from polyethylene, aluminium or metal.

Open Channels are subject to a number of problems including the collection of debris, such as leaves, moss and the like, resulting in blockages which reduce the efficacy of the gutter and must be removed by cleaning the gutter. The cleaning operation can be complicated and time-consuming and often requires the use of ladders or access machinery to access the gutters with their associated safety concerns. Additionally, once the debris gathers in the gutter, this causes vegetation to grow which will cause further blockages and unsightly damage to the building.

SUMMARY

It is an object therefore of the present invention to provide a rainwater gutter that overcomes most of the above-mentioned problems.

According to the invention there is provided a gutter for mounting on the fascia of a building the gutter comprising of a curved element having an upper curved part and a lower curved part terminating in a free end, wherein the lower curved part extends to form a substantially cylindrical channel having a narrow opening adjacent to the top thereof, wherein the free end approaches but is divided from the upper curved section, thus forming the opening. In this way, rainwater will flow from the roof onto the S shaped curved element, where, due to the contour of the gutter and the surface tension of the water, the rainwater will flow along the S-shaped curved section and into the opening in the channel, while the debris such as leaves and moss will not be able to pass through the opening and will therefore not enter the channel. Furthermore the narrowness of the opening will minimise the amount of light that enters the channel, thereby minimising the growth of any vegetation that might occur in the channel. In one embodiment of the invention there is provided a gutter in which the S-shaped curved element can be manufactured by extruding polythene in sections supported on brackets with joints at convenient intervals with a rubber gasket to form a continuous section to terminate at an outlet formed from a similar material to enter a conventional downpipe.

In another embodiment of the invention there is provided a gutter which is manufactured from aluminium. This would be produced by a forming machine on site. It would be supported by brackets at regular intervals and terminate at an end from an outlet into a conventional downpipe.

According to the invention there is provided a method of cleaning the gutter comprising the steps of passing a hose, for example that of a jetting machine, through the downpipe, up to the gutter where it would rest in the substantially cylindrical channel; spraying water into the substantially circular channel. This is a particularly convenient method of cleaning the gutter of invention as it is not necessary to use ladders to access the gutter.

DETAILED DESCRIPTION OF THE INVENTION

Figure 1:
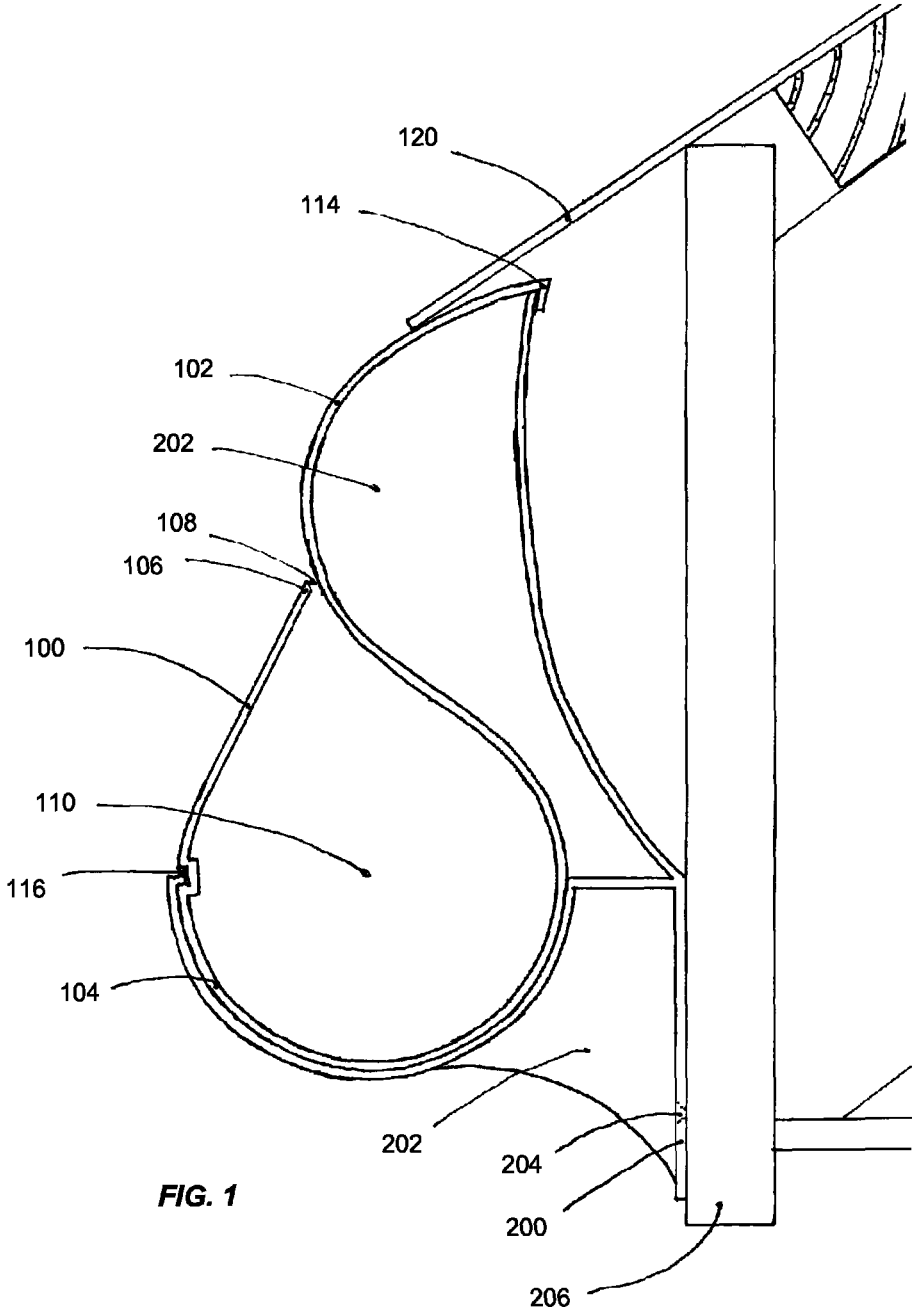
FIG. 1 is a diagrammatic representation of a cross section of the gutter according to the invention, mounted on a fascia.

The invention will now be more clearly understood from the following description of an embodiment thereof given by way of example only with reference to the accompanying drawings in which:

FIG. 1 is a diagrammatic representation of a cross section of the gutter according to the invention, mounted on a fascia.

Figure 2:
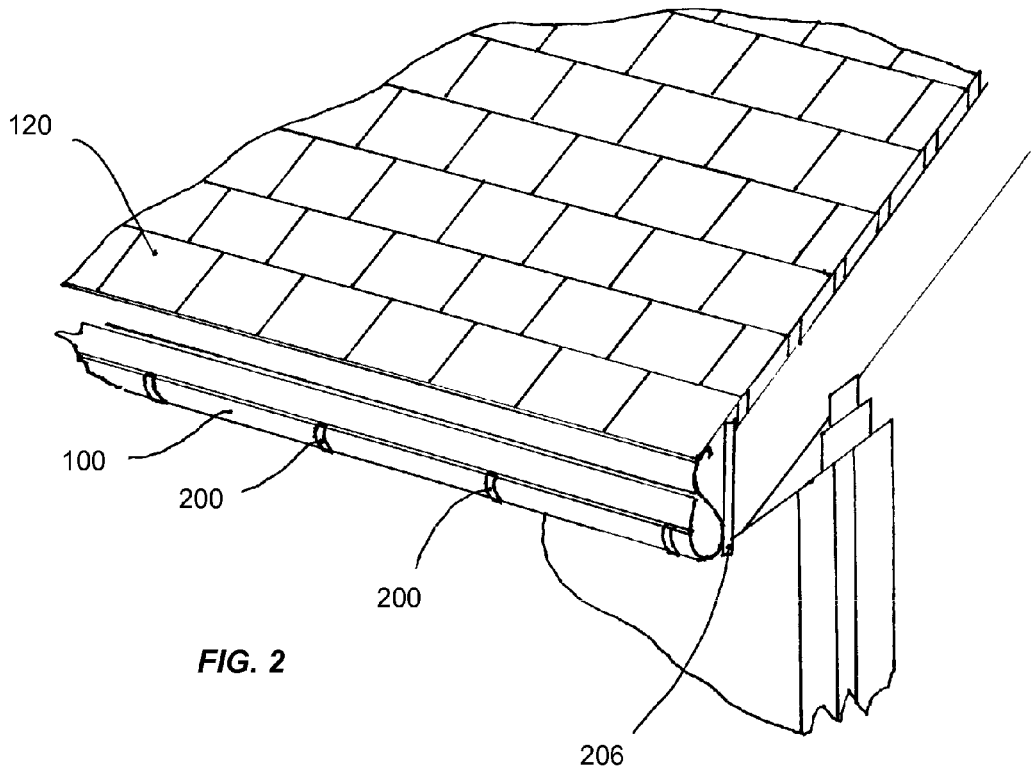
FIG. 2 is a perspective view of the gutter in place on the building.

FIG. 2 is a perspective view of the gutter in place on the building.

Figure 3:
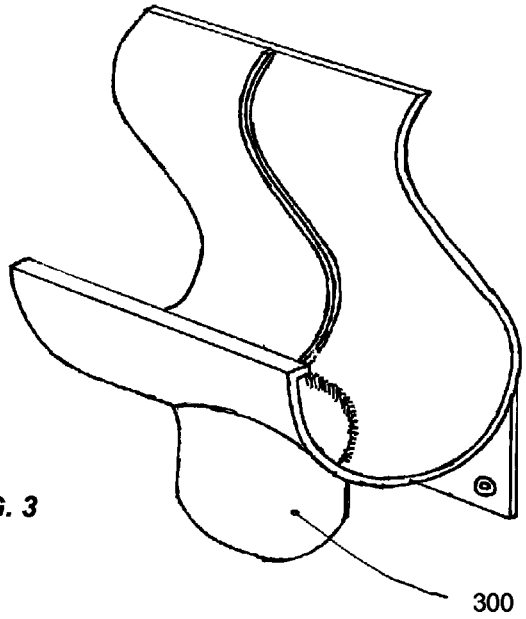
FIG. 3 is of the outlet.

FIG. 3 is of the outlet.

Figure 4:
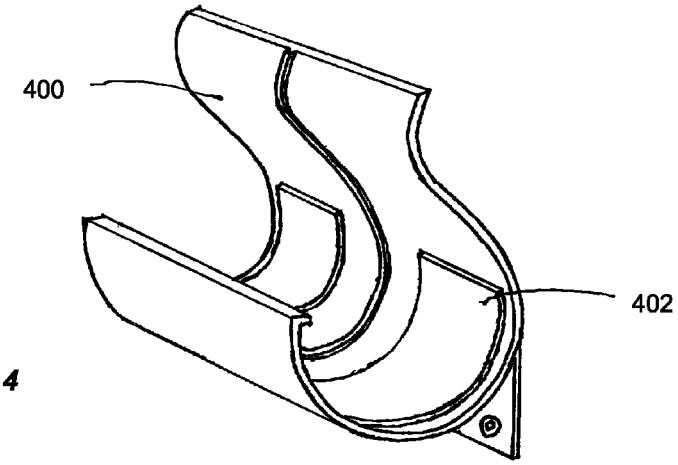
FIG. 4 is of the joint.

FIG. 4 is of the joint.

Figure 5:
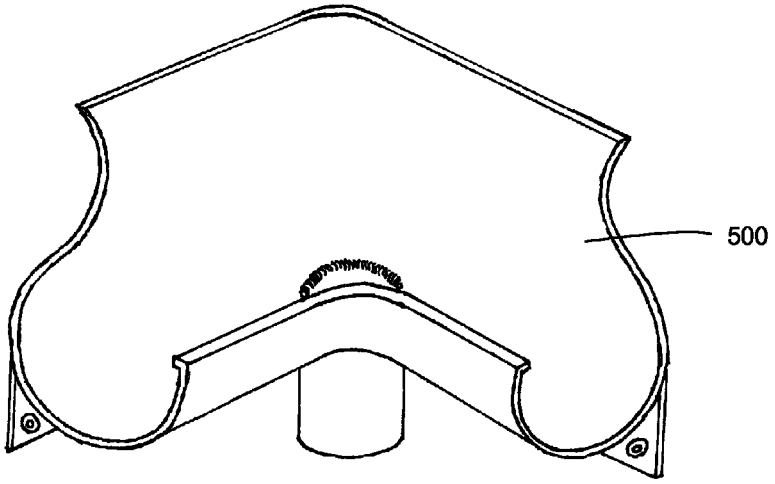
FIG. 5 is of the internal corner.

FIG. 5 is of the internal corner.

Figure 6:
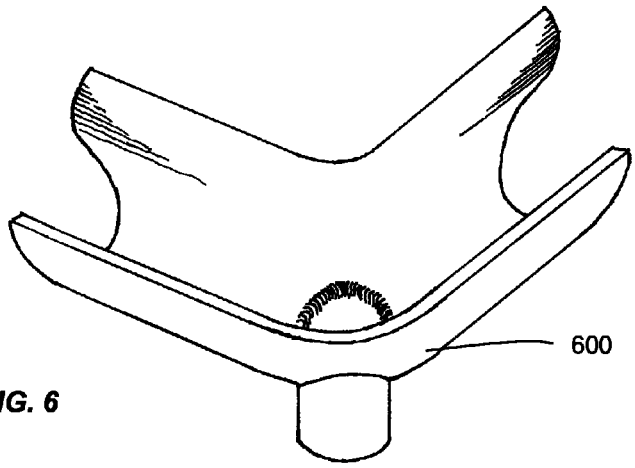
FIG. 6 is of the external corner.

FIG. 6 is of the external corner.

Referring to the drawings, and initially to FIG. 1 thereof, there is shown a gutter indicated generally by the reference numeral 100, comprising substantially of and S-shaped curved element, having an upper part 102 and having a lower part 104 and terminating at 106 to form a substantially cylindrical channel 110, where the cylindrical section terminates at 106 there is a gap 108 which allows the rainwater to enter the channel. There is a folded section at the top of 100 to form a point 114 to which a bracket 200 will fit to hold the top of the gutter. There is a slot 116 on the external side of 104 which holds the outer end of the bracket 200, thus holding the whole element in place, this will also assist with maintaining a constant opening at 108. There is a webbing 202 on the bracket 200 to give added strength. There are fixing holes 204 in the brackets for fitting screws to the fascia 206. The brackets are of varying depths, this is to allow for different overhangs from the roof covering 120 to allow the roof covering to sit on top of the gutter. The rainwater from the gutter enters the downpipe by means of an outlet 300 as in FIG. 3. The downpipe is fitted to the gutter in a similar way as the jointing section 400. There is a rubber gasket 402 into which the gutter rests in the jointing section which forms a seal when clipped into place. The internal 500 and external 600 corners can include an outlet as it would be a convenient location for an outlet.

According to the invention there is provided a gutter for mounting on the fascia of a building the gutter comprising of a curved element having an upper curved part and a lower curved part terminating in a free end, wherein the lower curved part extends to form a substantially cylindrical channel having a narrow opening adjacent to the top thereof, wherein the free end approaches but is divided from the upper curved section, thus forming the opening. In this way, rainwater will flow from the roof onto the S shaped curved element, where, due to the contour of the gutter and the surface tension of the water, the rainwater will flow along the S-shaped curved section and into the opening in the channel, while the debris such as leaves and moss will not be able to pass through the opening and will therefore not enter the channel. Furthermore the narrowness of the opening will minimise the amount of light that enters the channel, thereby minimising the growth of any vegetation that might occur in the channel. In one embodiment of the invention there is provided a gutter in which the S-shaped curved element can be manufactured by extruding polythene in sections supported on brackets with joints at convenient intervals with a rubber gasket to form a continuous section to terminate at an outlet formed from a similar material to enter a conventional downpipe.

In another embodiment of the invention there is provided a gutter which is manufactured from aluminium. This would be produced by a forming machine on site. It would be supported by brackets at regular intervals and terminate at an end from an outlet into a conventional downpipe.

According to the invention there is provided a method of cleaning the gutter comprising the steps of passing a hose, for example that of a jetting machine, through the downpipe, up to the gutter where it would rest in the substantially cylindrical channel; spraying water into the substantially circular channel. This is a particularly convenient method of cleaning the gutter of invention as it is not necessary to use ladders to access the gutter.

The invention claimed is:

1. A gutter adapted to be mounted on a building, for use in collecting rainwater, comprising:

a plurality of brackets which are attachable to a building;

a curved element having a generally S-shaped cross-section, which is mountable to the brackets and includes an upper part having a top, a concave portion for facing the building and adapted to curve downwardly and outwardly from the building, and that includes a folded section at the top which receives the brackets, and a lower part that extends from the upper part and is curved to form a substantially cylindrical channel, having an opening adjacent a top thereof and generally extending the length of the channel, and wherein the lower part includes an external surface received by the brackets, to retain the curved element therein; one or more outlet sections which are attachable to the curved element; and wherein, when mounted on the building for use in collecting rainwater, the rainwater is directed to flow over the upper part of the gutter, through the opening, and into the channel, and thereafter to the outlet sections.

2. The gutter of claim 1, further comprising a jointing section that enables two or more curved elements to be attached within the jointing section to form a continuous channel.

3. The gutter of claim 2, wherein the jointing section includes one or more gaskets that form a seal with the curved elements attached within the jointing section.

4. The gutter of claims 1, wherein the upper part of the gutter section allows rainwater to flow thereover by surface tension.

5. The gutter of claim 1, wherein the opening adjacent the top of the channel and generally extending the length of the channel is a size that generally allows the rainwater to enter the channel, while preventing debris from entering the channel.

6. The gutter of claim 5, wherein the opening adjacent the top of the channel is a size that reduces light entering the channel, to reduce growth of vegetation in the channel.

7. The gutter of claim 1, wherein the gutter is mountable proximate a roof of the building, using the one or more brackets that are mountable to a fascia of the building and that position the upper part of the gutter close to an edge of the roof, for use in collecting rainwater.

8. The gutter of claim 7, wherein at least two or more of the brackets are of different depths to accommodate different roof overhangs between the fascia of the building and the edge of the roof.

9. The gutter of claim 7, wherein each of the one or more brackets includes a top end, and wherein the folded section of the curved element receives the top end of the brackets to support the upper part of the gutter.

10. The gutter of claim 3, wherein the one or more gaskets are rubber gaskets.

11. The gutter of claim 1, wherein the gutter is made of one or more of a plastic material, an aluminum material, a copper material, or a zinc material.

12. The gutter of claim 1, wherein the external surface includes a slot along a length thereof which receives outer ends of the brackets, to retain the curved elements in the brackets.

13. The gutter of claim 1, wherein the outlet section enables two or more curved elements to be attached within the jointing outlet section, and wherein the jointing outlet section includes a downpipe outlet for connection to a downpipe.

14. The gutter of claim 13 wherein the outlet section includes one or more gaskets that form a seal with the curved elements attached within the outlet section.

15. The gutter of claim 13, wherein the outlet section is one of an internal corner or external corner.

16. The gutter of claim 1, wherein the gutter is self-cleaning including whereupon the rainwater being directed to flow through the opening and into the channel, it flows first down an internal back portion of the channel and then an internal front portion of the channel, to wash any residue within the channel.

17. The gutter of claim 1, wherein the channel accommodates a jetting machine for use in cleaning the channel.

18. The gutter of claim 13, wherein the downpipe outlet accommodates a jetting machine for use in cleaning the channel.

19. The gutter of claim 14, wherein the one or more gaskets are rubber gaskets.

* * * * *